US005987669A

United States Patent [19]

Leggett et al.

[11] Patent Number: 5,987,669

[45] Date of Patent: Nov. 23, 1999

[54] CLOSED BAFFLE CONSTRUCTION ARTICLE, BAFFLE GATE AND METHOD TO MAKE SAME

[75] Inventors: Gary Richard Leggett, Loveland; Marvin Werthaiser, Cincinnati, both of Ohio

[73] Assignee: Down Lite International, Loveland, Ohio

[21] Appl. No.: 08/911,873

[22] Filed: Aug. 15, 1997

[51] Int. Cl.[6] ..... A47G 9/02

[52] U.S. Cl. ..... 5/502; 5/950; 5/952; 112/420; 112/440

[58] Field of Search ..... 112/420, 440; 5/502, 500, 950, 951, 952, 413 R, 690

[56] References Cited

U.S. PATENT DOCUMENTS

| | | | |
|---|---|---|---|
| 921,664 | 5/1909 | Bates . | |
| 1,123,345 | 1/1915 | Micon | 5/690 |
| 2,878,481 | 3/1959 | Siminow | 112/420 X |
| 3,837,021 | 9/1974 | Sellers et al. . | |
| 4,152,796 | 5/1979 | Fogel . | |
| 4,208,748 | 6/1980 | Lobach . | |
| 4,426,945 | 1/1984 | A-Yan . | |
| 4,707,873 | 11/1987 | A-Yan . | |
| 4,839,934 | 6/1989 | Rojas . | |
| 5,187,825 | 2/1993 | Tesch . | |
| 5,199,121 | 4/1993 | Payne . | |
| 5,299,333 | 4/1994 | Pedersen et al. . | |
| 5,459,895 | 10/1995 | Kikuchi et al. | 5/502 |

FOREIGN PATENT DOCUMENTS

| | | | |
|---|---|---|---|
| 6184/27 | 1/1927 | Australia | 5/738 |
| 529155 | 7/1931 | Germany | 5/502 |

*Primary Examiner*—Michael F. Trettel
*Attorney, Agent, or Firm*—Frost & Jacobs LLP

[57] ABSTRACT

A substantially closed baffle construction, filled thermal article comprises at least one baffle made with overlapping ribbons. A first ribbon is not attached to the inner surface of the lower layer in the overlapping portion and a second ribbon is not attached at the inner surface of the upper layer in the overlapping portion. The baffles are attached to either vertical channel baffles or to the sides of the article. This provides a self-closing gate that permits fill material to be placed within the baffle but does not allow it to migrate after the baffle portion is filled. The article of the present invention can be machine-washed.

15 Claims, 7 Drawing Sheets

CLOSED BAFFLE CONSTRUCTION ARTICLE, BAFFLE GATE AND METHOD TO MAKE SAME

BACKGROUND OF THE INVENTION

This invention relates to a substantially closed baffle construction, filled article such as a down comforter, sleeping bag, or down jacket. More particularly, it relates to a substantially closed baffle construction article that is machine washable, wherein machine washable means that the article is able to washed with water in a typical mechanical washing machine without significant migration of fill material through the baffle gates. The invention further relates to a self-closing baffle gate. It also relates to a method for manufacturing a closed baffle construction thermal article.

Filled thermal articles typically have one of two constructions. Either the article has a closed construction or it has a random flow construction.

There are two types of closed constructions: baffle or sewn through. In an article with a closed baffle construction, ribbon-like baffles, attached to the upper and lower layers of an article and either the sides of the article or vertical channel baffles, separate the article into discrete portions so that the fill material is confined to the particular portion. Typically, the baffle will have an open gate area to allow the fill material to be fed into the article. Because the gate remains open after the article is filled, some fill material can migrate from one portion through the gate into another portion of the article. This undesirable migration is accelerated if an article is washed in a washing machine. Therefore, closed baffle construction articles must typically be dry cleaned to reduce the fill material migration.

A less expensive method of making an article with a closed construction is to sew through the upper and lower layers of the article after it has been filled. This has the advantage of providing a closed construction without the expense of adding a baffle. Such a sewn-though article can be machined washed. However, it has the disadvantage that the area of the upper and lower layer that has been sewn together results in a "cold spot" in the article. There is little or no thermal insulation at the sewn area. This results in an article that is not as thermally insulative as a closed baffle construction article. In addition, the sewn area results in a less aesthetically pleasing product. It does not have the loft and full appearance associated with traditional comforters with a baffle construction.

In a random flow article, the fill material is allowed to migrate throughout the article. While some random flow configurations can impede migration, there is nothing to prevent migration of the filler from one area to another area of the article.

Closed baffle construction is preferred for articles where migration of the fill material must be limited; however, it has the disadvantage that it cannot be machine-washed. Therefore, for many articles, particularly down comforters, where consumers prefer a machine washable product, a random flow article and a sewn through article are the only currently available alternatives.

The present invention provides a closed baffle construction article that can be machine-washed. It provides a gate within the baffle that allows the article to be filled, while at the same time preventing migration of the fill material during use and, particularly during machine washing.

SUMMARY OF THE INVENTION

The present invention provides a filled article comprising an upper layer with an inner surface and an outer surface; a lower layer with an inner surface and an outer surface; at least one baffle interposed between the inner surface of said upper layer and the inner surface of said lower layer; fill material contained between said upper layer, said lower layer and said at least one baffle; said baffle comprising a first ribbon and a second ribbon; each ribbon having a first edge and a second edge; the first and second ribbons overlapping each other for a portion of the length of said baffle; the first edge of said first ribbon being attached to the inner surface of said upper layer along substantially the entire length of said first ribbon and said first edge of said second ribbon being attached to the inner surface of said lower layer along substantially the entire length of said second ribbon; and the second edge of said first ribbon being attached to the inner surface of said lower layer along the length of said first ribbon except for a segment of the overlapping portion of the baffle.

The present invention also provides a self-closing baffle gate comprising a first ribbon and a second ribbon, each ribbon having a first edge and a second edge, the first and second ribbons overlapping each other for a portion of the length of said baffle; the first edge of said first ribbon being attached to the inner surface of said upper layer along substantially the entire length of said first ribbon and said first edge of said second ribbon being attached to the inner surface of said lower layer along substantially the entire length of said second ribbon, and the second edge of said first ribbon being attached to the inner surface of said lower layer along the length of said first ribbon except for a segment of the overlapping portion of the baffle.

The present invention further provides a method of manufacturing a filled thermal article comprising the steps of providing at least one baffle within a filled article wherein said baffle comprises a first ribbon and a second ribbon, each ribbon having a first edge and a second edge; overlapping the first and second ribbon for a portion of the length of said baffle; attaching the first edge of said first ribbon to the inner surface of said upper layer along substantially the entire length of said first ribbon; attaching the first edge of said second ribbon to the inner surface of said lower layer along substantially the entire length of said second ribbon; and, attaching the second edge of said first ribbon to the inner surface of said lower layer along the length of said first ribbon except for a segment of the overlapping portion of the baffle.

The present invention also provides a closed baffle construction article that can be machine washed.

DETAILED DESCRIPTION OF THE PREFERRED EMBODIMENTS

The present invention provides a filled article with a substantially closed baffle construction. While the article of the present invention and the method of the present invention could be used for any article, including, but not limited to, a sleeping bag, comforter, and jacket, the preferred embodiments of the present invention will be described as they apply to a comforter. However, the present invention is in no way limited to comforters.

Figure 1:
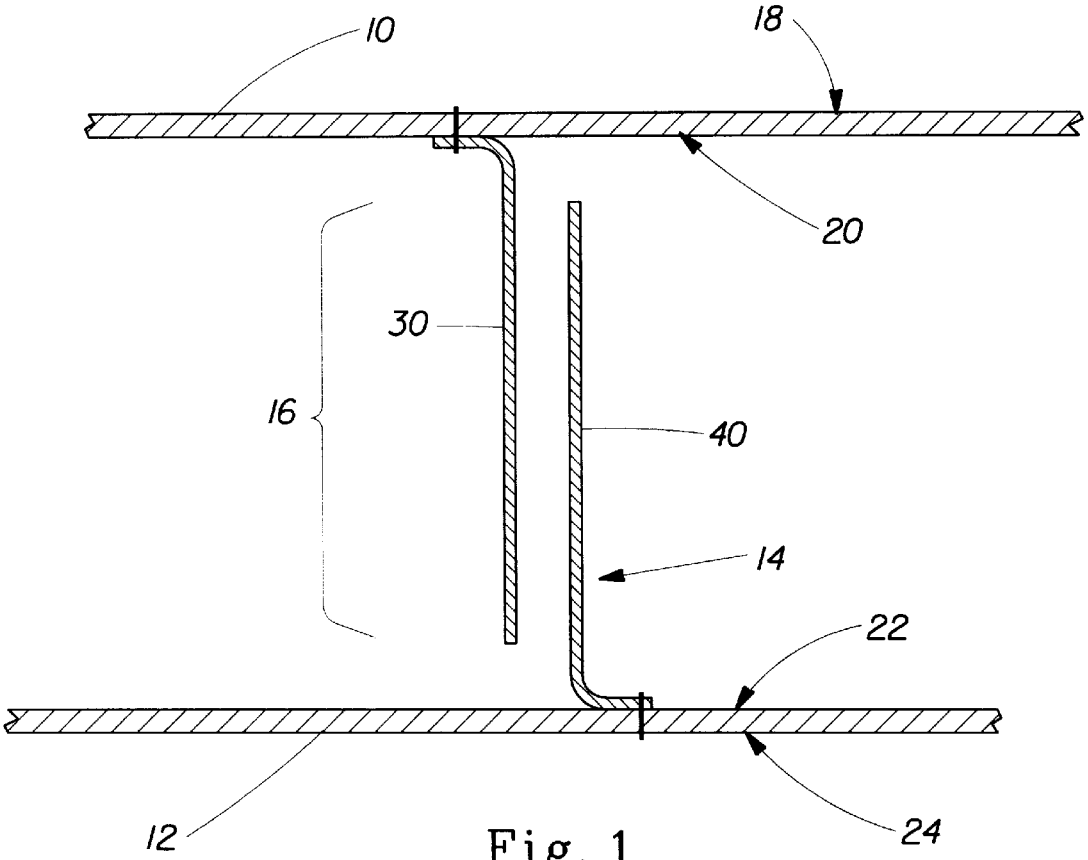
FIG. 1 is a fragmentary, simplified diagramatic, elevational view in cross section through the gate of a baffle of a first embodiment.

As shown in FIG. 1, the present invention comprises an article with an upper layer 10, a lower layer 12 and at least one baffle 14. The upper layer 10 and the lower layer 12 can each be made of any materials known in the art. The upper layer 10 and the lower layer 12 can each be made of the same material, or an article can be made with an upper layer 10 and a lower layer 12 that are made of different materials. The upper layer 10 and lower layer 12 can be made of a woven, knit or non-woven material. The material can be natural or synthetic fibers, including, but not limited to, cotton, polyester, silk, linen, nylon or any combination thereof. The material can include a waterproof material, used by itself or laminated to any other material. Preferably the upper layer 10 and the lower layer 12 are each a fabric made of woven cotton, polyester, silk, or a combination thereof.

Figure 8:
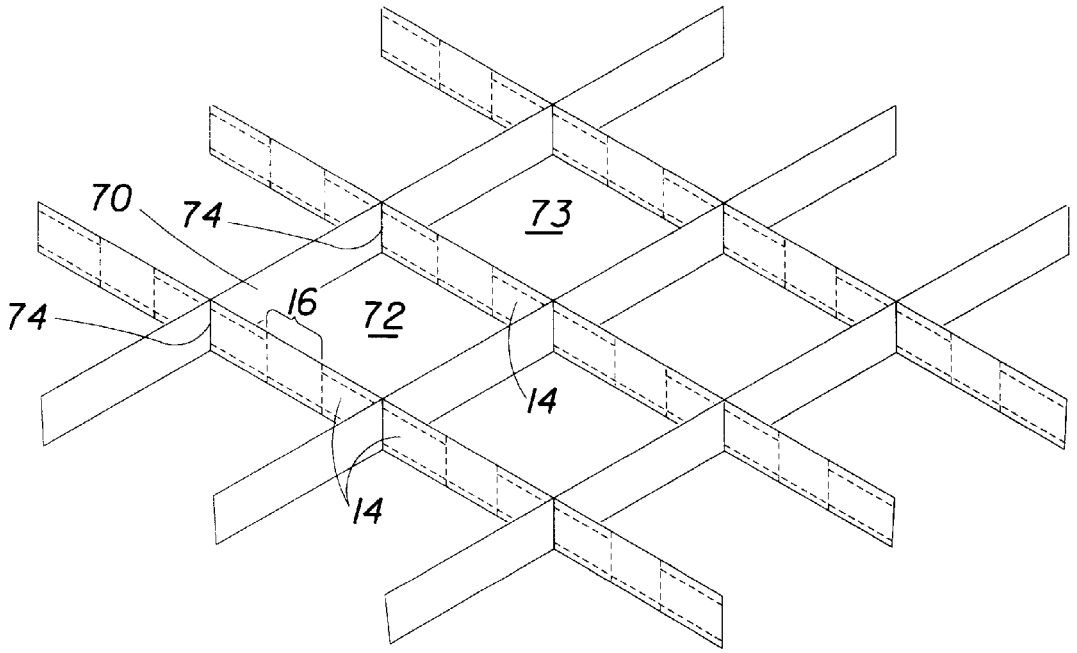
FIG. 8 is a fragmentary, simplified diagramatic perspective view in cross section of the article of the first embodiment with the upper layer removed.
Figure 9:
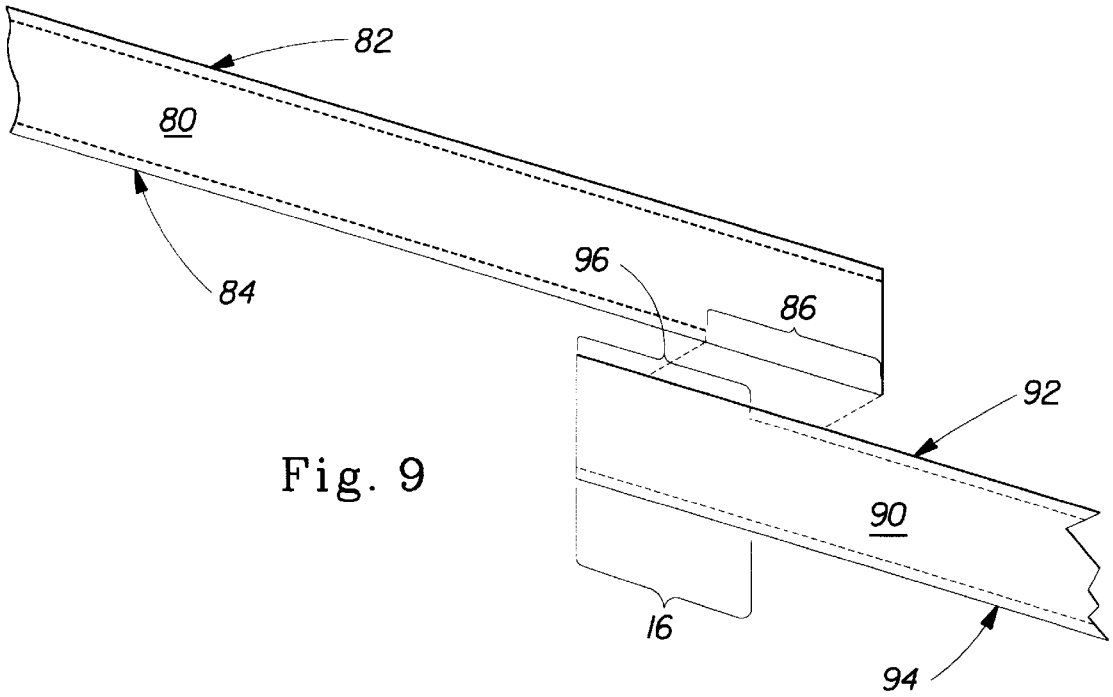
FIG. 9 is a fragmentary, simplified diagramatic, exploded perspective view of the gate of the second embodiment.

The baffle 14 of the present invention connects the upper layer 10 to the lower layer 12. As shown in FIG. 8, the article of the present invention must have at least one baffle 14, which divides the article into at least two portions, 72 and 73. Preferably, the article has a plurality of baffles 14. Each baffle 14 is attached at each of its ends 74 to either a vertical channel baffle 70 or an edge of the article (not shown).

Figure 13:
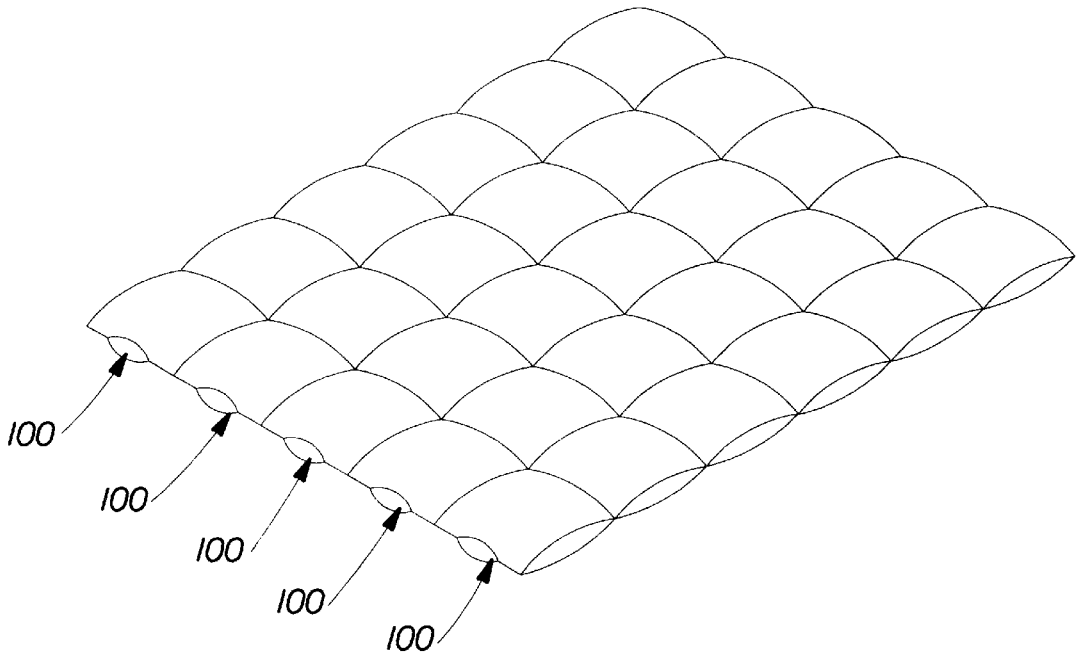
FIG. 13 is a fragmentary, simplified diagramatic perspective view of a comforter.

The baffles 14 can be arranged in any configuration. They may be arranged in horizontal rows with vertical channel baffles creating columns so as to create a plurality of "boxes" within the article. See FIGS. 8 and 13. The baffles 14 can also be arranged to form a "frame" around the circumference of the article. There is no limitation on the baffle configurations that can be used with the present invention. Any functional or decorative arrangement of baffles can incorporate the gate of the present invention.

Figure 2:
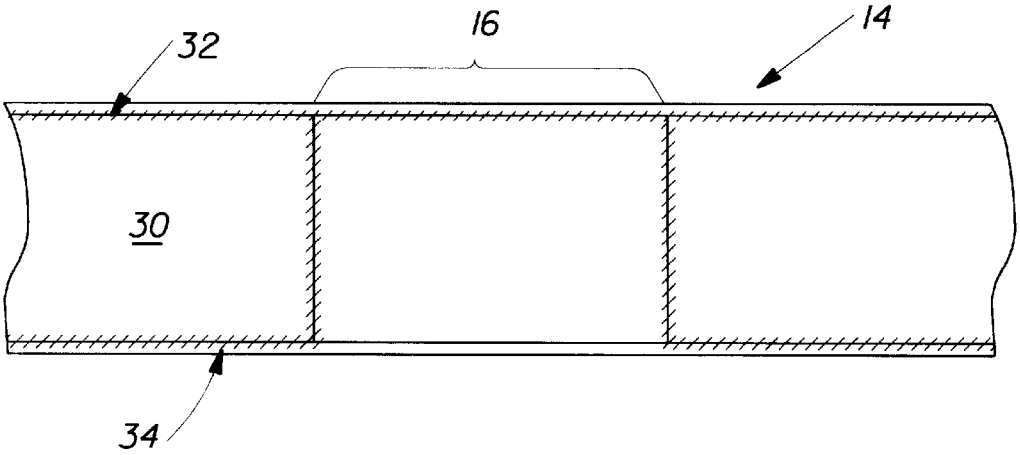
FIG. 2 is a fragmentary, simplified diagramatic, elevational view of the front side of the gate of the first embodiment.
Figure 3:
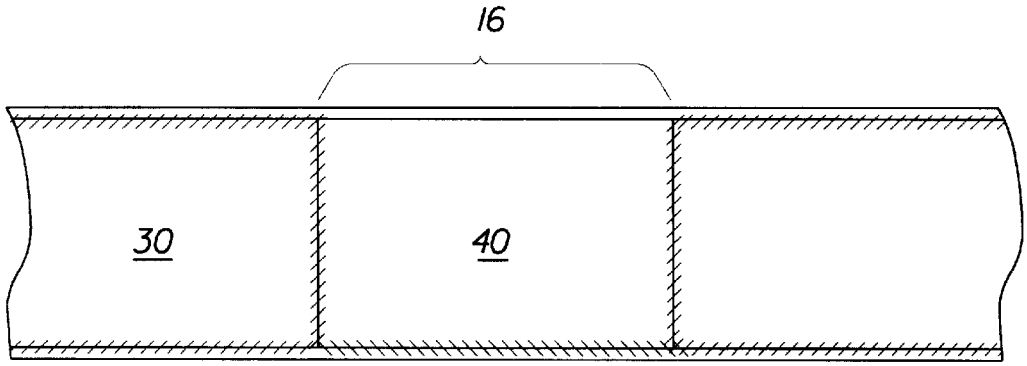
FIG. 3 is a fragmentary, simplified diagramatic, elevational view of the back side of the gate of the first embodiment.
Figure 4:
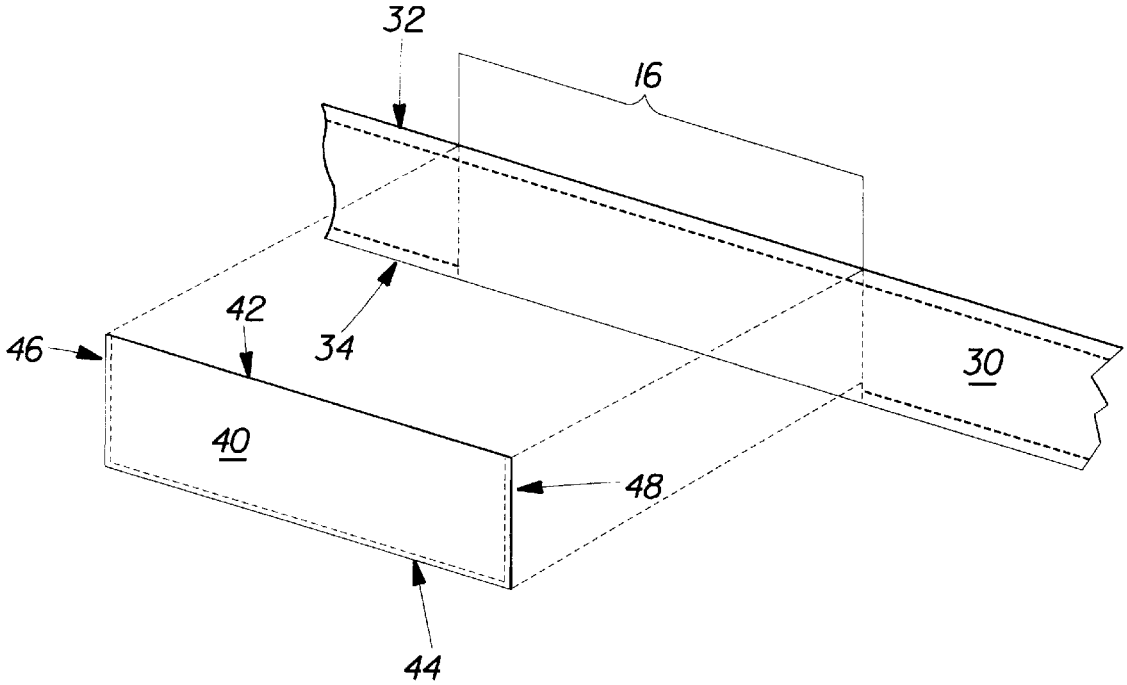
FIG. 4 is a fragmentary, simplified diagramatic, exploded perspective view of the gate of the first embodiment.
Figure 5:
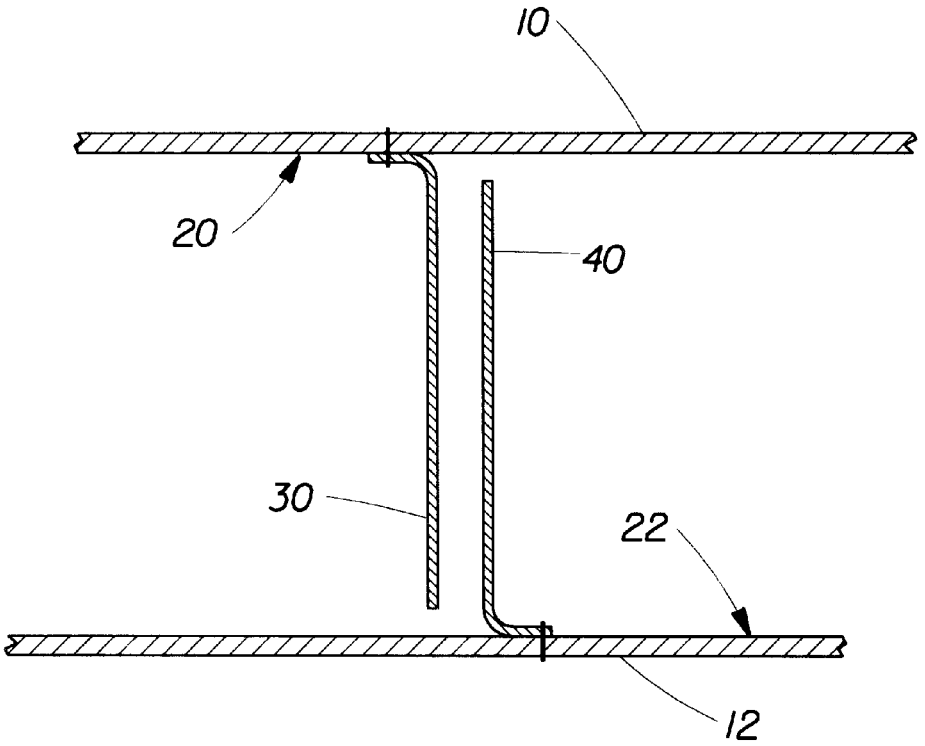
FIG. 5 is a fragmentary, simplified diagramatic view in cross section of the gate of the first embodiment.
Figure 6:
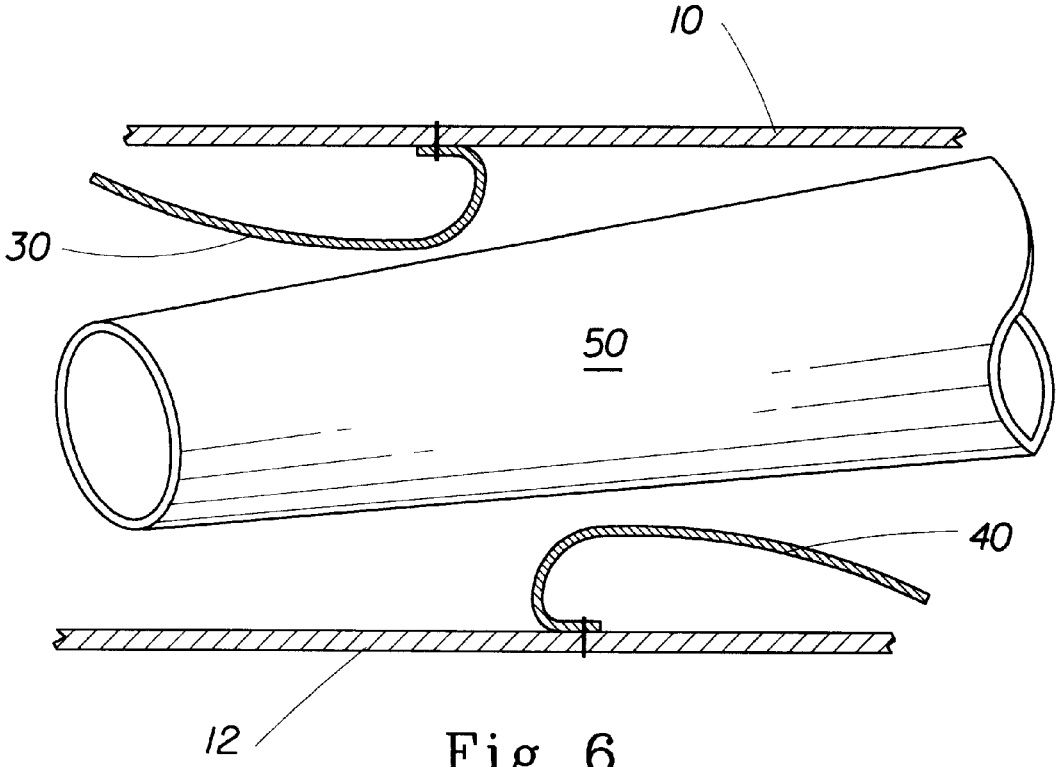
FIG. 6 is a fragmentary, simplified diagramatic view, partly in cross section, showing a fill nozzle inserted in the gate of the first embodiment.
Figure 7:
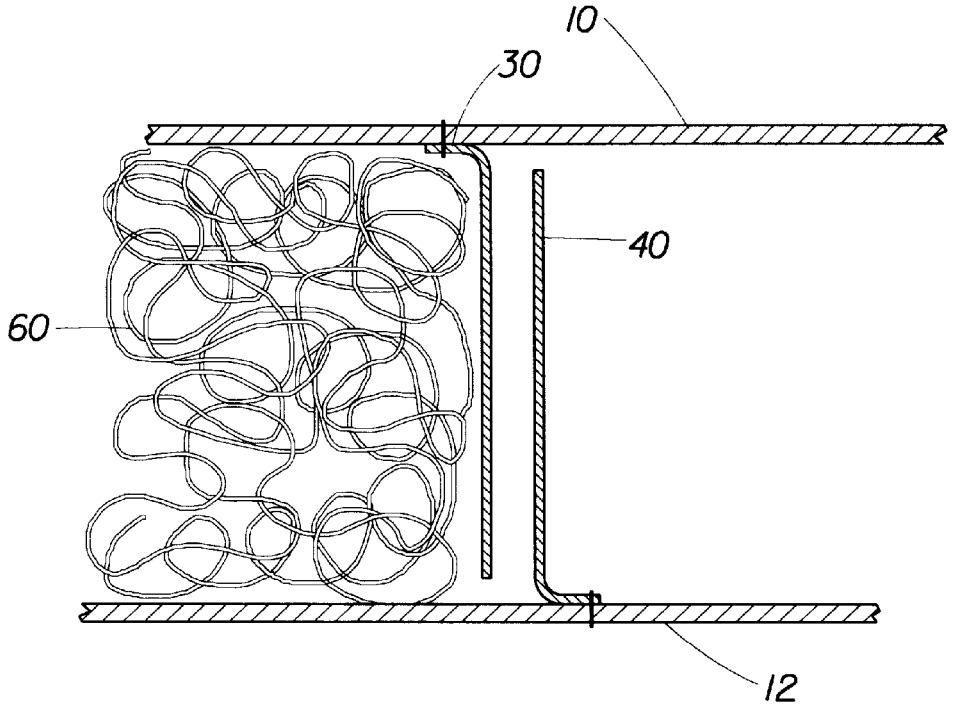
FIG. 7 is a fragmentary, simplified diagramatic view in cross section of the gate of the first embodiment, closed under pressure of the fill material.

The baffle 14 of the present invention comprises at least one ribbon. Preferably it comprises at least two ribbons, a first ribbon 30 and a second ribbon 40. See FIG. 1. The first and second ribbons, 30 and 40 respectively, overlap each other for a portion of the length of the baffle 14. It is in this overlapping portion that a gate 16 is formed. See FIG. 8. As FIG. 1 shows, the ribbons, 30 and 40, are attached to the inner surfaces of the upper layer 10 and the lower layer 12, respectively, of the thermal article. At the gate 16, as can be seen in FIGS. 2 and 5, the first ribbon 30 is not attached to the lower layer 12 and, similarly, at the gate 16, shown in FIG. 3, the second ribbon 40 is not attached to the upper layer 10. This allows for the insertion of a fill nozzle 50 under the first ribbon 30 and over the second ribbon 40 so that the fill material 60 can be fed into the article. See FIG. 6. When the nozzle 50 is removed, the gate 16, which had been forced apart by the fill nozzle 50, closes because the ends 74 (shown in FIG. 8) are attached to the vertical channel baffles 70 and because of the pressure of the fill material 60. See FIG. 7. The fill material 60 and the attachment of the ends 74 forces the baffle 14 to "stand up", causing the overlapping ribbons, 30 and 40, to contact each other, closing the gate 16. This prevents migration of the fill material 60 through the gate 16.

The ribbons, 30 and 40, of the baffle 14 can be made of any material known in the art for making baffles. The material must have sufficient resiliency that the baffle 14 will return to approximately its original configuration after the fill nozzle has been removed. It is preferable that the material not be so stiff as to be easily noticeable in the filled thermal article. If the ribbons, 30 and 40, are too stiff, they can act like ribs. This makes the article less flexible and, therefore, not as desirable to the consumer. Preferably, the ribbons, 30 and 40, are a woven, knit or non-woven material. More preferably, the ribbons, 30 and 40, are a woven muslin material or a nylon netting.

The ribbons, 30 and 40, can be attached to the inner surfaces of the upper and lower layers, 10 and 12, of the article and at the ends of the baffles 14 by any means known in the art. Preferably, they are attached by sewing.

The length of the first and second ribbons, 30 and 40, can vary. The first and second ribbons, 30 and 40, can both be of sufficient length that they both substantially extend the length of the baffle 14. The second ribbon 40 may be shorter than the first ribbon 30, so that it is approximately the same length as the gate 16, or just slightly longer than the gate 16. The first and second ribbon, 30 and 40, can each be slightly longer than one-half the overall length of the baffle 14, so that they overlap near the middle of the baffle 14. It is important that the first and second ribbon, 30 and 40, overlap in the gate 16; their respective lengths are less important.

In a first embodiment, the first ribbon 30 runs the length of the baffle 14. See FIGS. 4–7. The first edge 32 of the first ribbon 30 is attached to the inner surface 20 of the upper layer 10. The second edge 34 of the first ribbon 30 is attached to the inner surface 22 of the lower layer 12 except for an area that will make up the gate 16. A second ribbon 40 is attached along its two ends, 46 and 48, to the first ribbon 30 and attached along its first edge 44 to the inner surface 22 of the lower layer 12. The second edge 42 of the second ribbon 40 is not attached to the inner surface 20 of the upper layer 10, thereby providing a gate 16 wherein a fill nozzle 50 can be inserted under the second edge 34 of the first ribbon 30 and over the second edge 42 of the second ribbon 40.

In a second embodiment shown in FIGS. 9–12, the first and second ribbons, 80 and 90 respectively, each comprise slightly more than one-half the length of the baffle 14. They overlap each other so that the first edge 82 of the first ribbon 80 is attached along its entire length to the inner surface 20 of the upper layer 10. The second edge 84 of the first ribbon

80 is also attached to the inner surface 22 of the lower layer 12 along all but a part of an overlapping end 86 of its length. Similarly, the first edge 94 of the second ribbon 90 is attached to the inner surface 22 of the lower layer 12 along its entire length. The second edge 92 of the second ribbon 90 is attached to the inner surface 20 of the upper layer 10 along all but an overlapping end 96. When the fill nozzle 50 is inserted, it goes under the first ribbon 80 and over the second ribbon 90.

In a third embodiment of the present invention, the baffle 14 comprises one ribbon. This ribbon must be made of an elastic material. The gate 16 comprises a horizontal slit in the ribbon. Preferably, this slit is reinforced. Because the material is elastic, the fill nozzle can inserted through the slit. When the fill nozzle is removed, the elastic material returns to its original shape and the slit closes, thereby preventing migration of the fill material.

In a fourth embodiment of the present invention, the baffle 14 comprises a ribbon with a slit that is mechanically closeable. This gate can be closed by any means that can be repeatably attached and detached, without damage to the closing means or the ribbon. Such means can include snaps, zippers, and hook and loop attaching material. After the fill nozzle is removed, the closing means are closed, thereby allowing the article to be machine washed without fill material migration.

Figure 10:
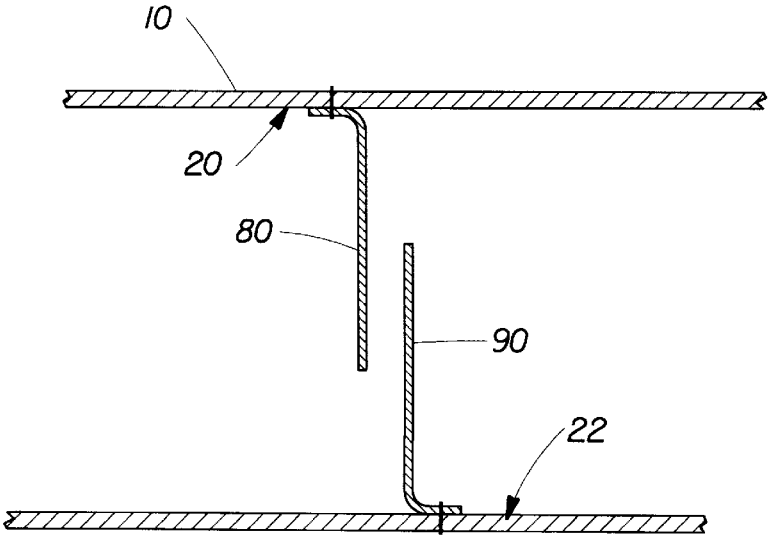
FIG. 10 is a fragmentary, simplified diagramatic view in cross section of the gate of the second embodiment.
Figure 11:
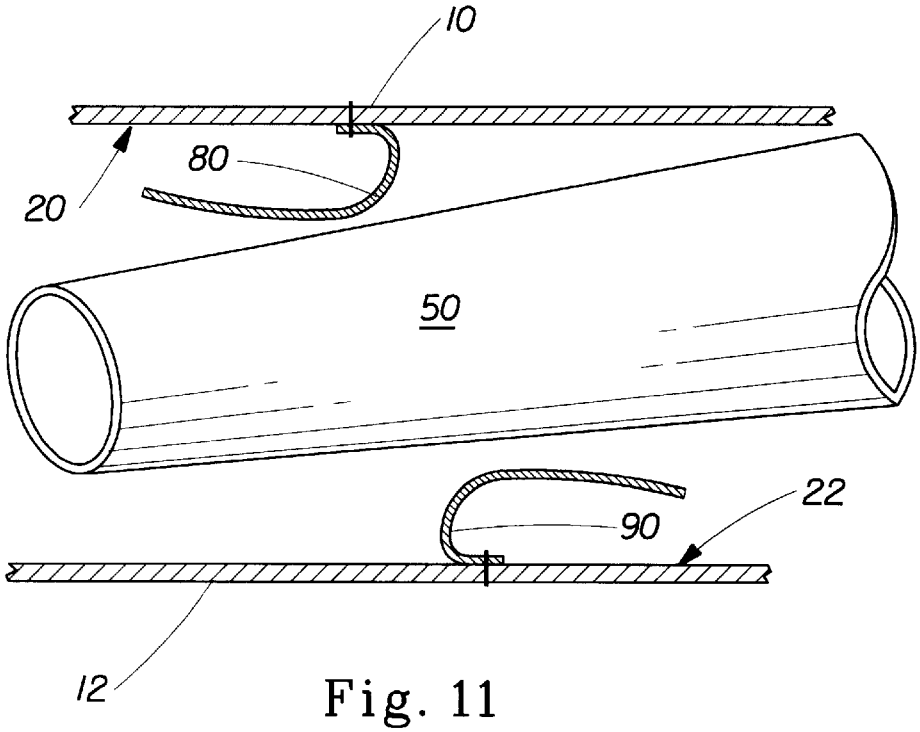
FIG. 11 is a fragmentary, simplified diagramatic view, partly in cross section, showing a fill nozzle inserted in the gate of the second embodiment.
Figure 12:
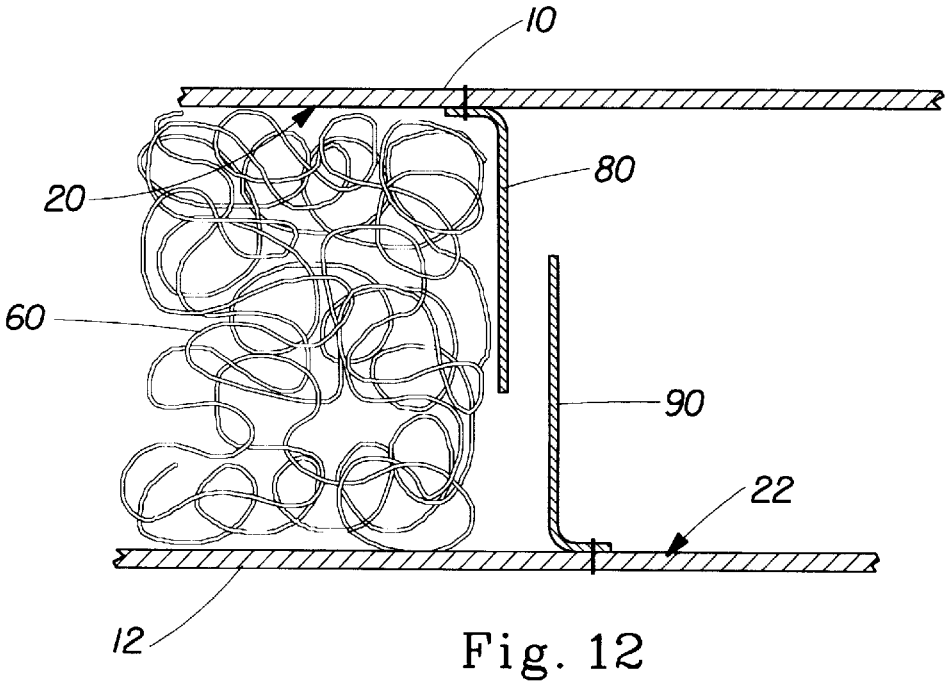
FIG. 12 is a fragmentary, simplified diagramatic view in cross section of the gate of the second embodiment, closed under pressure of the fill material.

The first and second ribbons, 30 and 40, may overlap each other substantially across their entire width. See FIGS. 2 and 5. As shown in FIG. 10, they may overlap each other only over some portion of their width.

The articles of the present invention can be filled with any natural or synthetic fill material, including, but not limited, to down, synthetic materials, wool, feathers, cotton, silk, and combinations thereof. Preferably, the article is filled with a thermally insulative material.

When filling the article of the present invention, a fill nozzle 50 is inserted through fill openings 100. See FIG. 13. The nozzle 50 is then pushed through the gates 16 in each one of the baffles 14 until the end of the article is reached. As each baffle portion is filled, the nozzle 50 is pulled back into the next baffle portion and fills the next baffle portion. Each successive baffle portion is thus filled sequentially.

As FIG. 8 shows, the gates 16 of the present invention can be located anywhere along the length of the baffle 14. It is preferable that the gate 16 be located away from a vertical channel baffle 70. It is more preferable that the gate 16 be located approximately in the center of the baffle 14. It is most preferable that the gates 16 be aligned with each other in such a way that a fill nozzle 50 can be inserted through several gates 16 at one time. Preferably the gate 16 is approximately one (1) inch in height and approximately five (5) inches in length, wherein height is the distance between the upper layer 10 and the lower layer 12 and length is measured along the unattached, overlapping areas of the first ribbon 30 and the second ribbon 40, as shown in FIG. 5.

The invention has been described in terms of a comforter; however, it can be used for any article including a sleeping bag, jacket, pillow, and feather bed. The detailed description of the preferred embodiment is not meant to limit the application of the filled article, the baffle gate, or the method of the present invention.

What is claimed is:

1. A filled article comprising:

an upper layer with an inner surface and an outer surface;

a lower layer with an inner surface and an outer surface;

at least one baffle interposed between the inner surface of said upper layer and the inner surface of said lower layer; and, fill material contained between said upper layer, said lower layer and said at least one baffle;

said baffle comprising a first ribbon and a second ribbon; each ribbon having a first edge and a second edge; the first and second ribbons overlapping each other for a portion of the length of said baffle; the first edge of said first ribbon being attached to the inner surface of said upper layer along substantially the entire length of said first ribbon and said first edge of said second ribbon being attached to the inner surface of said lower layer along substantially the entire length of said second ribbon; and the second edge of said first ribbon being attached to the inner surface of said lower layer along the length of said first ribbon except for a segment of the overlapping portion of the baffle.

2. The filled article of claim 1 wherein said first ribbon extends substantially the length of the baffle, wherein said second ribbon has two ends; and said second ribbon is attached to said first ribbon at each of its two ends.

3. The filled article of claim 1 wherein the second edge of said second ribbon is attached to the inner surface of the upper layer except for a segment of the overlapping portion of the baffle.

4. The filled article of claim 1 comprising a plurality of baffles.

5. The filled article of claim 4 wherein said article is selected from the group consisting of a comforter, a coat, a featherbed and a sleeping bag.

6. The filled article of claim 1 wherein said fill material is selected from the group consisting of down, feathers, wool, synthetic materials, and combinations thereof.

7. A self-closing baffle gate disposed between an inner surface of an upper layer and an inner surface of a lower layer, comprising a first ribbon and a second ribbon, each ribbon having a first edge and a second edge, the first and second ribbons overlapping each other for a portion of the length of said baffle; the first edge of said first ribbon being attached to the inner surface of said upper layer along substantially the entire length of said first ribbon, said first edge of said second ribbon being attached to the inner surface of said lower layer along substantially the entire length of said second ribbon, and the second edge of said first ribbon being attached to the inner surface of said lower layer along the length of said first ribbon except for a segment of the overlapping portion of the baffle.

8. The filled article of claim 7 wherein said first ribbon extends substantially the length of the baffle, wherein said second ribbon has two ends, and wherein said second ribbon is attached to said first ribbon at each of its two ends.

9. The filled article of claim 7 wherein the second edge of said second ribbon is attached to the inner surface of the upper layer except for a segment of the overlapping portion of the baffle.

10. A method of manufacturing a filled article comprising the steps of:

providing at least one baffle within a filled article disposed between an inner surface of an upper layer and an inner surface of a lower layer, wherein said baffle comprises a first ribbon and a second ribbon, each ribbon having a first edge and a second edge;

overlapping the first and second ribbon for a portion of the length of said baffle;

attaching the first edge of said first ribbon to the inner surface of said upper layer along substantially the entire length of said first ribbon;

attaching the first edge of said second ribbon to the inner surface of said lower layer along substantially the entire length of said second ribbon; and, attaching the second edge of said first ribbon to the inner surface of said lower layer along the length of said first ribbon except for a segment of the overlapping portion of the baffle.

11. The method of claim 10 wherein said first ribbon extends substantially the length of the baffle, wherein said second ribbon has two ends, and further comprising the step of attaching each of the two ends of said second ribbon to said first ribbon.

12. The method of claim 10 further comprising the step of attaching the second edge of said second ribbon to the inner surface of the upper layer except for a segment of the overlapping portion of the baffle.

13. A comforter comprising:

an upper layer with an inner surface and an outer surface;

a lower layer with an inner surface and an outer surface;

a plurality of gated baffles interposed between the inner surface of said upper layer and the inner surface of said lower layer;

a plurality of vertical channel baffles arranged approximately perpendicularly to said plurality of gated baffles, and, fill material contained between said upper layer, said lower layer, said plurality of gated baffles, and said plurality of vertical channel baffles;

each gated baffle comprising a first ribbon and a second ribbon; each ribbon having a first edge and a second edge; the first and second ribbons overlapping each other for a portion of the length of said baffle; the first edge of said first ribbon being attached to the inner surface of said upper layer along substantially the entire length of said first ribbon and said first edge of said second ribbon being attached to the inner surface of said lower layer along substantially the entire length of said second ribbon; and the second edge of said first ribbon being attached to the inner surface of said lower layer along the length of said first ribbon except for a segment of the overlapping portion of the baffle.

14. The filled article of claim 13 wherein said first ribbon extends substantially the length of the gated baffle, wherein said second ribbon has two ends; and said second ribbon is attached to said first ribbon at each of its two ends.

15. The filled article of claim 13 wherein the second edge of said second ribbon is attached to the inner surface of the upper layer except for a segment of the overlapping portion of the gated baffle.

* * * * *